US006664455B2

(12) United States Patent
Aoki

(10) Patent No.: US 6,664,455 B2
(45) **Date of Patent: *Dec. 16, 2003**

(54) TONE HOLE PAD FOR A WIND INSTRUMENT

(75) Inventor: Hiroshi Aoki, Tokorozawa (JP)

(73) Assignee: Muramatsu Flute Manufacturing Co., Ltd., Tokorozawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/270,339

(22) Filed: Oct. 15, 2002

(65) Prior Publication Data

US 2003/0070532 A1 Apr. 17, 2003

(30) Foreign Application Priority Data

Oct. 15, 2001 (JP) ..... 2001-316987

(51) Int. Cl.[7] ..... G10D 7/08
(52) U.S. Cl. ..... 84/385 P; 84/385 A
(58) Field of Search ..... 84/385 P, 385 A

(56) References Cited

U.S. PATENT DOCUMENTS

| | | | | |
|---|---|---|---|---|
| 3,295,403 A | | 1/1967 | Kindlesparker | |
| 4,967,632 A | | 11/1990 | Etheredge, III et al. | |
| 5,183,954 A | | 2/1993 | Wasser | |
| 5,417,135 A | | 5/1995 | Straubinger | |
| 5,469,771 A | | 11/1995 | Wasser | |
| 6,015,946 A | | 1/2000 | Yamaryo | |
| 6,028,256 A | | 2/2000 | Straubinger | |
| 6,284,958 B1 | * | 9/2001 | Aoki et al. | 84/385 P |
| 6,344,604 B1 | * | 2/2002 | Schmidt | 84/385 P |

FOREIGN PATENT DOCUMENTS

| | | |
|---|---|---|
| JP | 9-305166 | 11/1997 |

* cited by examiner

*Primary Examiner*—Kimberly Lockett
(74) *Attorney, Agent, or Firm*—Wenderoth, Lind & Ponack, L.L.P.

(57) ABSTRACT

A tone hole pad to close a tone hole of a musical wind instrument is mounted in a cup having a bottom portion and a wall portion. A circular metallic base has a diameter substantially the same as the inside diameter of the wall portion of the cup and is brazed to the bottom surface thereof. The metallic base has a plurality of holes formed at regular intervals between the stem portion and the periphery of the surface thereof. A peripheral portion of the rear surface is beveled to conform to a curved portion of the inside bottom portion of the metal cup. A metallic holder, having an outside diameter substantially the same as the inside diameter of the wall portion of the cup, is provided with a wall portion with a lip which curves inward to prevent the pad's surface from floating and a ring-shaped recess formed in the peripheral upper surface thereof having an inside diameter smaller than the tone hole. A pad assembly of a felt body and an elastic resin plate is inserted in the metallic holder, mounted on the metallic base together with a mount paper, and fixed by a pad washer and a bolt.

10 Claims, 10 Drawing Sheets

TONE HOLE PAD FOR A WIND INSTRUMENT

BACKGROUND OF THE INVENTION

1. Field of the Invention

The present invention relates to a tone hole pad for a musical wind instrument in which the pad is mounted within a cup for opening or closing a tone hole.

2. Description of the Prior Art

A conventional tone hole pad for a wind instrument is shown in FIGS. 13 to 17, and comprises a circular metal cup 32 including a bottom portion and a wall portion formed on the periphery of the bottom portion. A screw receiver 33 is brazed to the cup 32 (FIG. 15), and a cushion pad 35 and an adjusting paper 36 are mounted in the cup 32. The cushion pad 35 is formed of a thick felt 39 backed by cardboard 40 and wrapped in a pad skin 41, and has a mounting hole 42 formed in the center thereof (FIG. 16). The adjusting paper 36 is first placed on the bottom portion of the cup and the cushion pad 35 is mounted thereon and then fixed by a pad washer 37 and a bolt 38 (FIG. 17). The adjusting paper 36 may regulate the pad's surface in order to contact with a tone hole's rim 34 by increasing or decreasing the surface level. The cup 32 mounted with the cushion pad and the adjusting paper is brazed to a lever 31 of a key mechanism provided on the outer surface of a tube body of the instrument.

One of the problems in the prior art tone hole pad is conformability of the cushion pad 35 with the tone hole's rim 34, i.e. air leaks from a gap produced between the pad's surface and the tone hole's rim. A first reason for this is that the screw receiver 33 is liable to be obliquely brazed to the bottom portion of the cup 32. The oblique screw receiver makes the pad washer 37 unevenly press the cushion pad 35 against the bottom portion of the cup 32, and, accordingly, reduces the conformability of the cushion pad 35. In the process of manufacture, in fact it is hard for a worker to braze the screw receiver to the bottom portion of the cup 36 evenly, because it requires a skillful technique. A second reason is the uneven bottom portion of the cup 32. When the cushion pad 35 is pressed by the pad washer 37 against the uneven bottom portion of the cup, the cushion pad is then distorted, whereby a gap is produced between the pad's surface and the tone hole's surface and air leaks, even though the adjusting paper lies on the bottom portion of the cup.

A further problem is that tears in the cushion pad's skin can eventually occur on the portion of the skin that covers the cushion pad. The tears are caused by the pad's inability to maintain an even tension on the skin during repeated contact with the tone hole surface. Therefore, a pad assembly is needed having components that can provide the necessary support for the pad's sealing surface and maintain an even tension on the pad's skin. The deformation of the cushion pad caused by the uneven bottom surface of the cup as described in the previous paragraph is also a cause of tears in the cushion pad's skin. Replacement of the pad assembly requires the installation of a new pad assembly and adjustment to conform the cushion pad's surface to the tone hole surface and is both time consuming and expensive.

A further problem is that in the prior art tone hole pad the cushion pad is fixed by a pad washer and bolt in the center. In other words, only the central area of the cushion pad is pressed firmly against the bottom portion of the cup. Accordingly, the pressure of the pad washer is concentrated near the center of the pad so that the outer peripheral portion of the cushion pad is forced to float up and protrude out at an edge of the wall portion of the cup, causing distortion of the cushion pad, and so the pad's conformability is reduced. Any measures to prevent the outer peripheral portion of the cushion pad's surface from protruding out at the edge of the cup wall are awaited.

SUMMARY OF THE INVENTION

Accordingly, an object of this invention is to provide a tone hole pad for a musical wind instrument that has solved the above problems inherent in the prior art conventional tone hole pad.

To achieve the above object, according to one aspect of this invention, there is provided a tone hole pad for a wind instrument comprising a circular metal cup brazed to a lever of a key mechanism provided on the outer surface of a tube body of the wind instrument, including a bottom portion and an annular wall portion formed on the peripheral portion of the bottom portion. A circular metallic base, which includes a stem portion formed integrally therewith exactly perpendicular to the surface thereof, within which a female screw is formed, is brazed to the bottom portion of the metal cup. The metallic base is formed of a disk-shaped metal plate having a diameter substantially the same as the inside diameter of the wall portion of the metal cup, is provided with a plurality of holes formed at regular intervals between the central stem portion and the peripheral portion of the upper surface thereof, and has a beveled portion formed in a corner portion of the periphery of the rear surface thereof to coincide with a curved portion of the inner peripheral portion of the bottom portion of the metal cup. This beveled portion enables the metallic base to be placed in a proper position in the metal cup.

There is provided a tray-shaped metallic holder having an outside diameter just inside the wall portion of the metal cup and a mounting hole formed in the center thereof. The outer periphery thereof forms a wall portion with a lip which curves inward toward the center thereof. The lip prevents the pad's surface from floating. Inside the wall portion thereof is formed a ring-shaped concave portion having an outside diameter just inside the wall portion, an inside diameter smaller than the tone hole and an appropriate width and depth to form a space portion into which an elastic resin plate deflects when the tone hole is closed.

A pad assembly is comprised of a felt body formed of a disk-shaped piece of felt, having an upper surface coated with a resin film, a diameter the same as that of the metallic base and a mounting hole formed in the center thereof, and an elastic resin plate formed of a disk-shaped elastic resin plate having the same diameter as of the felt body and a mounting hole formed in the center thereof. The felt body and elastic resin plate are inserted in the metallic holder, which is mounted on the metallic base with the interposition of a circular mount paper formed of disk-shaped cardboard, having the same diameter as that of the felt body and a mounting hole formed in the center thereof, and being fixed by a pad washer and a bolt in the cup.

In accordance with the tone hole pad of the present invention, the following effects and advantages can be achieved.

First, in the process of manufacture, it is easier to settle the metallic base in a proper position in the bottom portion of the metal cup owing to the beveled portion formed in the peripheral portion of the rear surface thereof covering the whole inside rounded portion of the bottom portion of the cup. When the metallic base is brazed to the bottom portion of the cup, a number of the holes perforated between the stem portion and the periphery of the metallic base are of use for a worker through which he can observe with the eye the brazing work and condition on the other surface of the metallic base when it is brazed to the bottom surface of the metal cup. This enhances the work efficiency and contributes to reducing weight.

As a result, a stem portion can be stabilized exactly perpendicular to and in the center of the bottom portion of the metal cup by the existence of the metallic base. Accordingly, the pad assembly can be pressed by a pad washer evenly so as to maintain its surface parallel to the tone hole surface, so that it avoids any risk giving rise to damage to the pad's surface which causes a gap and air leakage. Accordingly, complete conformability of the pad's surface with the tone hole can be ensured.

As comprised of the thin felt body, the upper surface of which is coated with the resin film, the elastic resin plate and the mount paper, the pad assembly itself is elastically deformable and restorable. Thus the pad cannot suffer from excessive pressure from the tone hole by a player's violent touch or uneven pressure by distortion of the tone hole. Also, the space portion in the ring-shaped concave portion provided in the peripheral portion of the upper surface of the metallic holder allows deflection of the elastic resin plate when the tone hole is closed.

Further, the pad according to the present invention is durable for long use, since all the pad components are held by the metallic holder.

DESCRIPTION OF THE PREFERRED EMBODIMENTS

The embodiments of the present invention will be described with reference to the accompanying drawings. However, it is needless to say that the present invention is not restricted to the embodiments described below.

Figure 1:
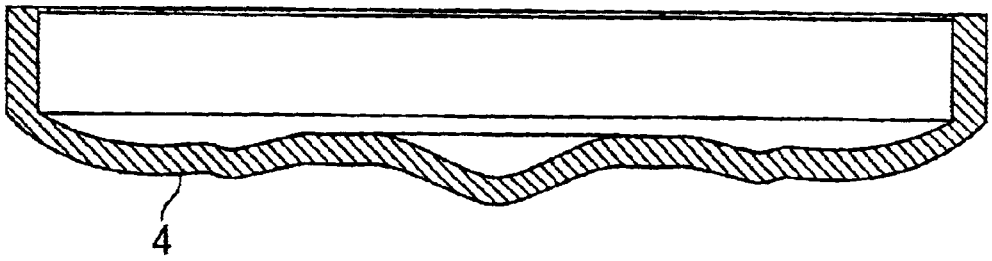
FIG. 1 is a sectional view of a metal cup of the present invention.

FIG. 1 shows a metal cup 4 having a bottom portion and a wall portion formed in the peripheral portion of the bottom portion.

Figure 2:
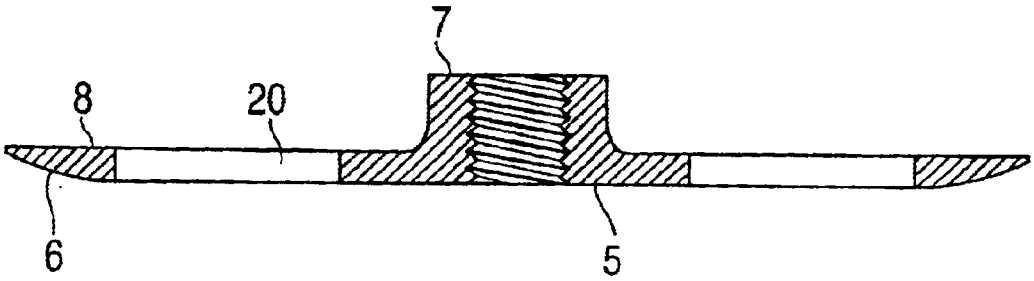
FIG. 2 is a sectional view of a circular metallic base of the present invention.
Figure 3:
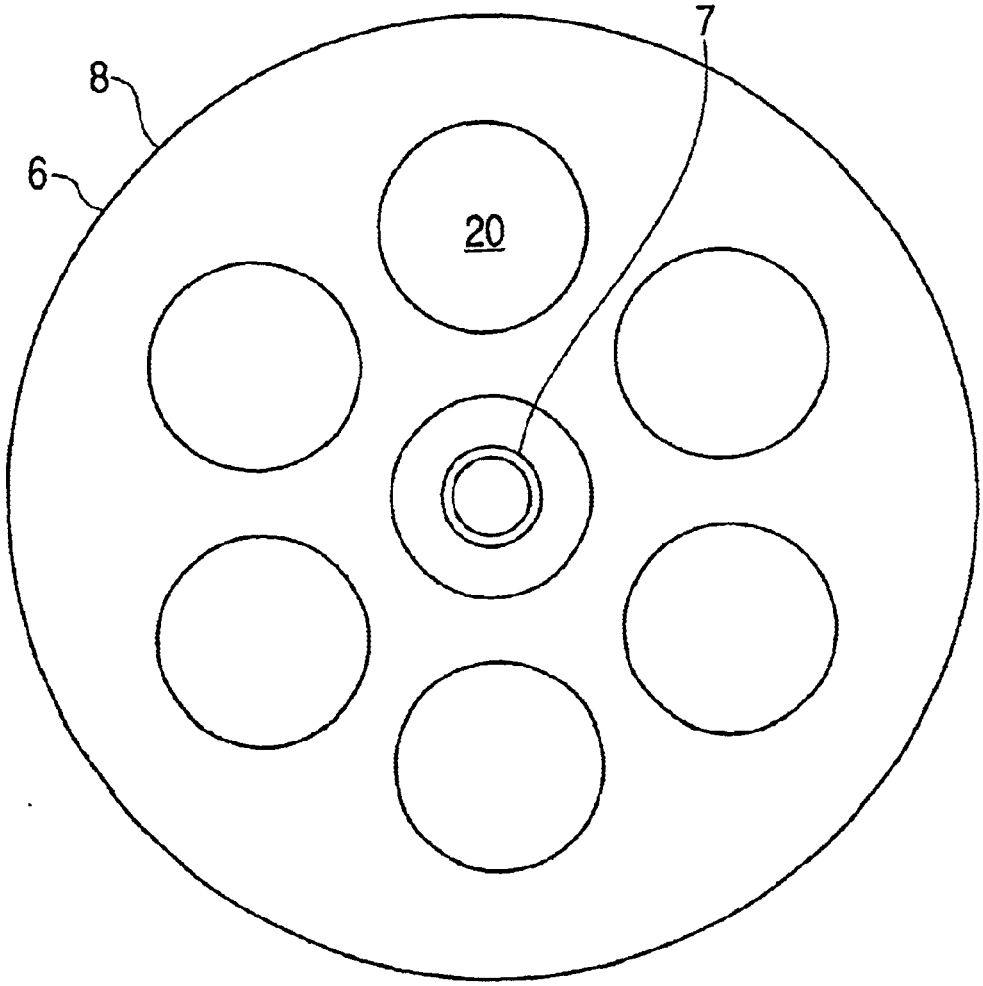
FIG. 3 is a plan view of the circular metallic base.
Figure 4:
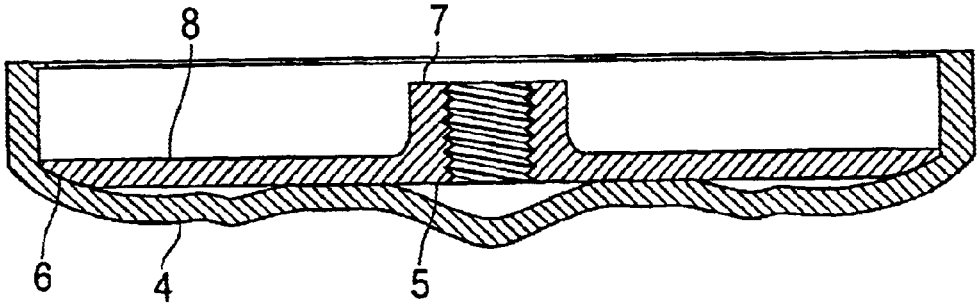
FIG. 4 is a sectional view of the circular metallic base brazed to the bottom surface of the metal cup.
Figure 5:
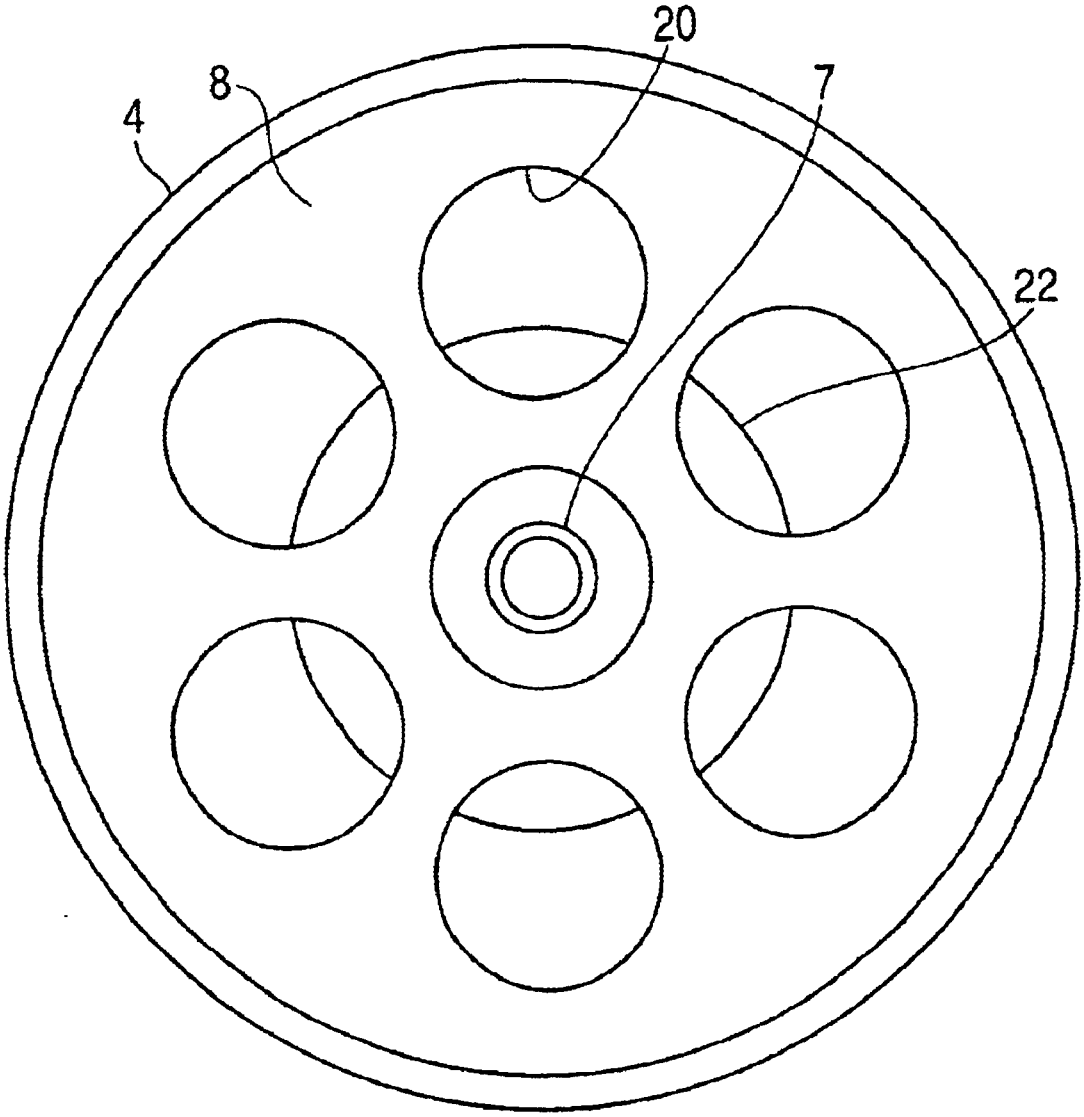
FIG. 5 is a plan view of the circular metallic base brazed to the metal cup.

FIGS. 2 and 3 show a circular metallic base 8 and a stem portion 7 integrally formed therewith within which a female screw is formed. The circular metallic base, having a diameter substantially the same as the inside diameter of the wall portion of the metal cup 4, is provided with a plurality of holes 20 formed at regular intervals between the stem portion 7 and the periphery thereof, as shown in FIG. 3. These holes 20 are of help when it is brazed to a bottom surface 22 of the metal cup 4, through which a worker can see with the eye his brazing work and condition on the other surface of the metallic base, and contribute to reducing weight. A peripheral portion of rear surface 5 of the metallic base 8 is beveled at 6 to coincide with the curved portion of the inner peripheral portion of the metal cup 4, so that the metal base can be easily placed in a proper position in the bottom portion of the cup and brazed thereto as shown in FIG. 4.

Figure 6:
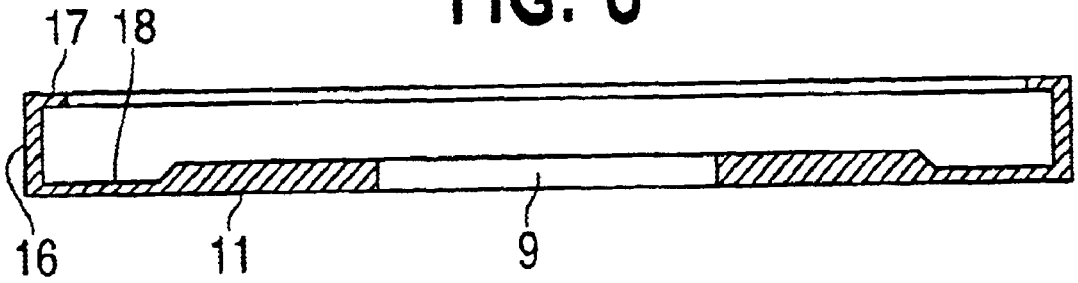
FIG. 6 is a sectional view of a metallic holder of the present invention.
Figure 7:
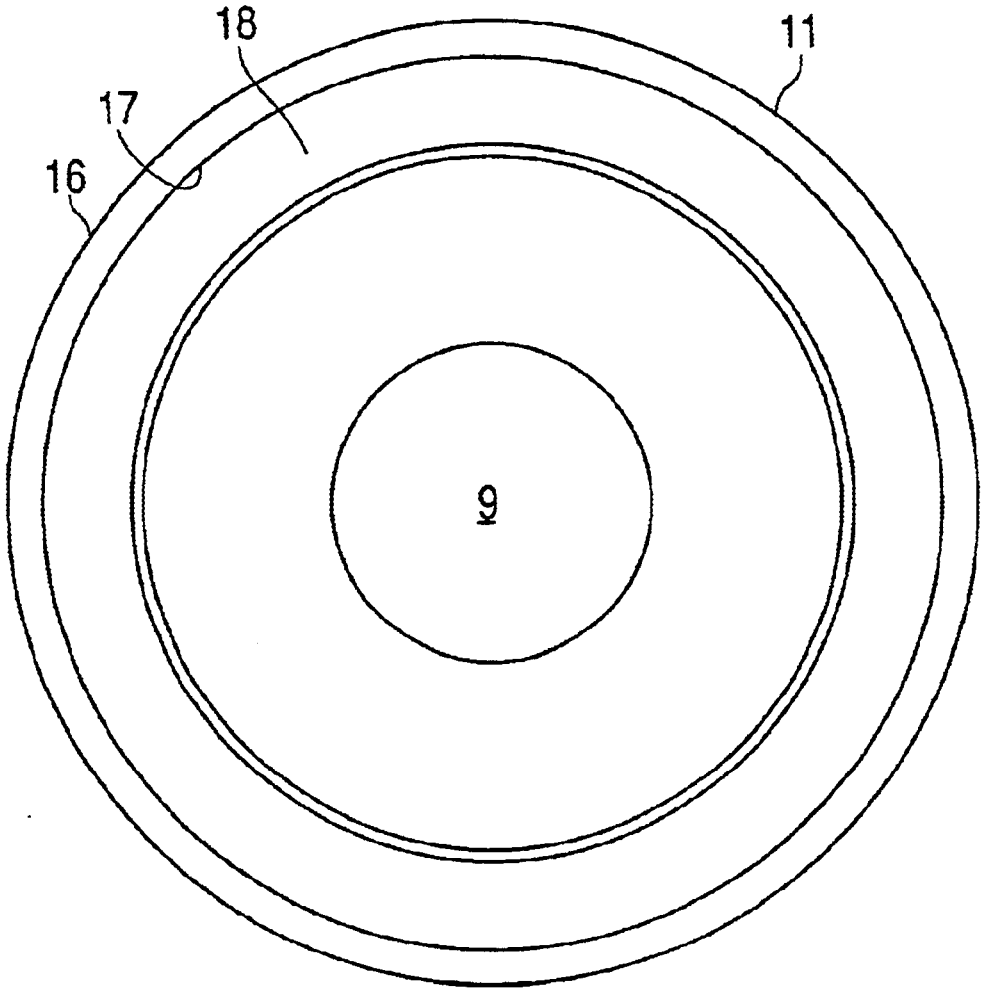
FIG. 7 is a plan view of the metallic holder.

FIGS. 6 and 7 show a tray-shaped metallic holder 11 having an outside diameter just inside the wall portion of the metal cup and a mounting hole 9 formed in the center thereof. The outer periphery thereof forms a wall portion 16 with a lip 17 which curves inward toward the center thereof. The lip prevents the pad's surface from floating. Inside the wall portion 6 is formed a ring-shaped concave portion 18 having an outside diameter just inside the wall portion 16, an inside diameter smaller than the tone hole 1, and an appropriate width and depth.

Figure 8:
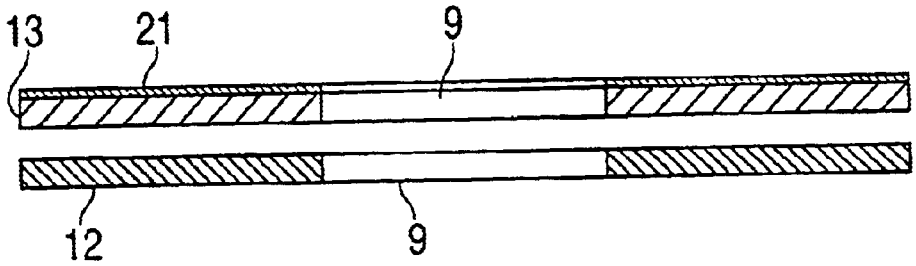
FIG. 8 is a sectional view of a felt body and an elastic circular resin plate.
Figure 9:
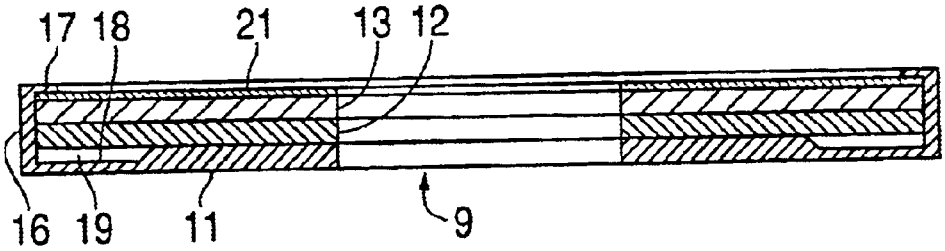
FIG. 9 is a sectional view of the felt body and the elastic circular resin plate mounted in the metallic holder.

FIG. 8 shows a felt body 13 formed of a disk-shaped piece of felt, the upper surface of which is coated with a resin film 21 made e.g. from a polyvinyl chloride. The felt body 13 has a diameter just inside the wall portion 16 of the metallic holder 11 and a mounting hole 9 formed in the center thereof. An elastic resin plate 12 is formed of elastic resin plate such as silicone rubber, has the same diameter as that of the felt body 13, and has a mounting hole 9 formed in the center thereof. The felt body 13 and the elastic resin plate 12 are inserted inside the surface of the metallic holder 11 as shown in FIG. 9.

Figure 10:
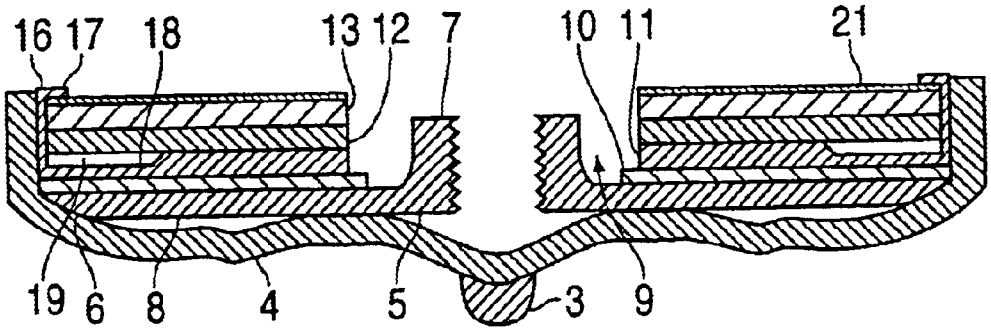
FIG. 10 is a sectional view showing a state in which the metallic holder mounted with the felt body and the elastic circular resin plate is mounted on the metallic base, with the interposition of a mount paper.

FIG. 10 shows a state in which the metallic holder 11, having the felt body 13 and the elastic resin plate 12 inserted therein, is mounted on the metallic base 5 with the interposition of a mount paper 10. The mount paper 10 is formed of cardboard, having a diameter the same as that of the felt body and a mounting hole 9 formed in the center thereof, and serves as an adjusting member in order to determine the desired level of the pad's surface in contact with the tone hole.

Figure 11:
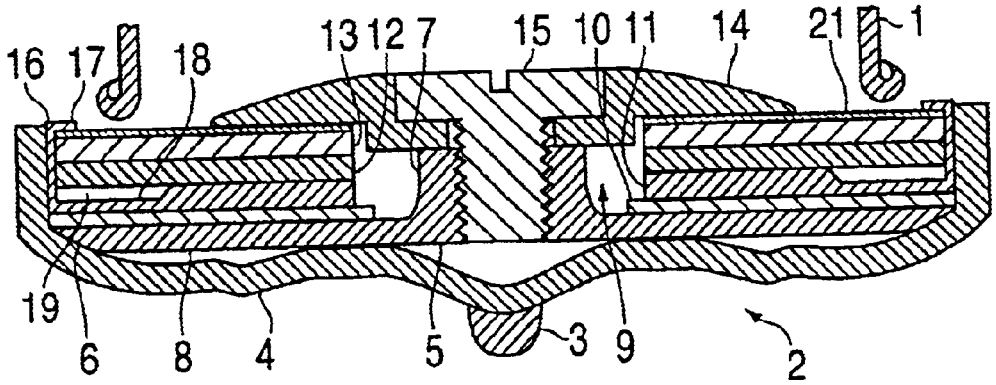
FIG. 11 is a sectional view of a finished tone hole pad according to the present invention.

As shown in FIG. 11, all the elements are finally fixed by a pad washer 14 and a bolt 15 in the cup, which is brazed to a lever 3 of the key mechanism provided on the outer surface of the tube body of the instrument.

Figure 12:
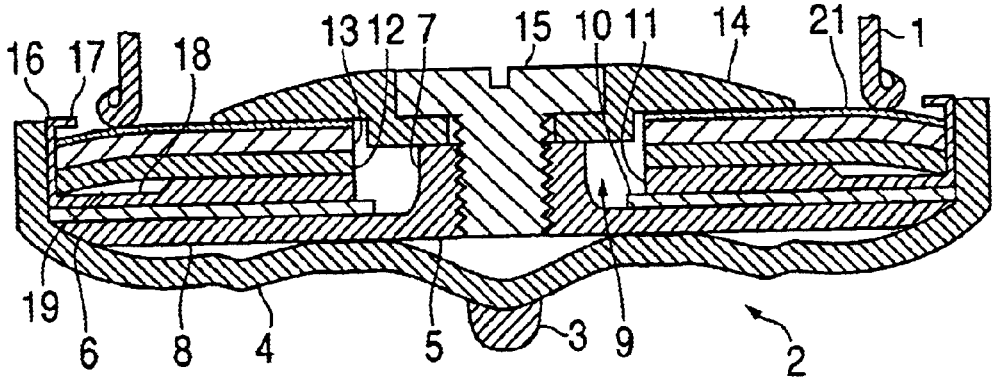
FIG. 12 is a sectional view showing a state in which the tone hole is closed.
Figure 13:
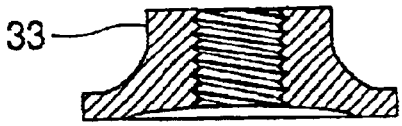
FIG. 13 (PRIOR ART)
FIG. 13 is a sectional view of a prior art screw receiver.
Figure 14:
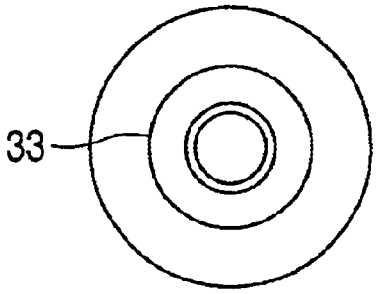
FIG. 14 (PRIOR ART)
FIG. 14 is a plan view of the prior art screw receiver.
Figure 15:
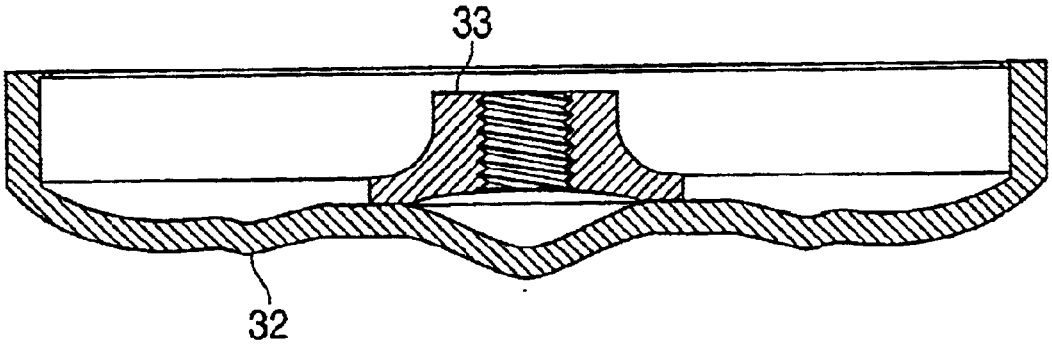
FIG. 15 (PRIOR ART)
FIG. 15 is a sectional view of the prior art screw receiver brazed to a cup.
Figure 16:
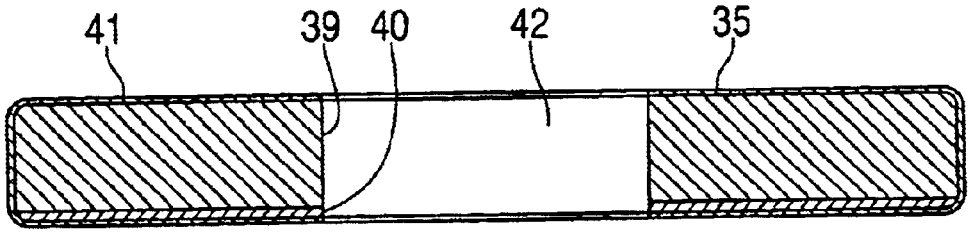
FIG. 16 (PRIOR ART)
FIG. 16 is a sectional view of a prior art cushion pad.
Figure 17:
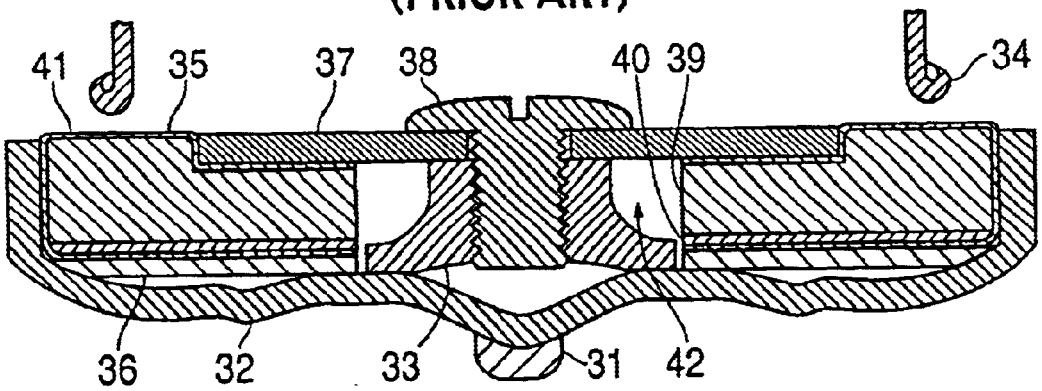
FIG. 17 (PRIOR ART)
FIG. 17 is a sectional view of a prior art finished tone hole pad.

FIG. 12 shows a state in which the tone hole 1 is closed by the tone hole pad according to the present invention. As shown, the elastic resin plate 12 deflects into a space portion 19 formed in the ring-shaped concave portion 18 provided on the inner periphery of the bottom portion of the metallic holder 11 so as to moderate the shock caused when the tone hole is closed.

What is claimed is:

1. A tone hole pad holding assembly for use in opening and closing a tone hole of a wind instrument with a pad assembly, comprising:

a metal cup having a bottom portion and a wall portion, the wall portion having an inside diameter;

a circular metallic base inside said metal cup, said metallic base having a diameter substantially the same as the inside diameter of the wall portion of said metal cup, a stem portion formed integrally with said metal base and having an internal female screw, a plurality of holes at regular intervals between said stem portion and a periphery of said metallic base, and a beveled portion formed on a peripheral portion of a rear surface of said metallic base; and a metallic holder inside said metal cup having an outer diameter the same as the inside diameter of said wall portion of said metal cup, a wall portion with a lip and a ring-shaped concave portion formed in a peripheral portion of said metallic holder, said concave portion having an inside diameter smaller than the tone hole.

2. The tone hole pad holding assembly of claim 1, wherein said beveled portion conforms with a curved portion of said bottom portion of said metal cup.

3. The tone hole pad holding assembly of claim 1, wherein said lip of said metallic holder extends inward toward a center of said metallic holder.

4. A tone hole pad for opening and closing a tone hole of a wind instrument, comprising:

a cup having a bottom portion and a wall portion, the wall portion having an inside diameter;

a circular metallic base inside said cup and fixed with respect to said cup, said base having a diameter substantially the same as the inside diameter of the wall portion of said cup;

a holder inside said cup having an outer diameter the same as the inside diameter of said wall portion of said cup, a wall portion and an annular peripheral recess having an inside diameter smaller than the tone hole; and a pad assembly in said holder;

wherein said circular base has a stem portion formed integral therewith, and wherein a washer is connected to said stem portion to hold said pad assembly in said cup.

5. The tone hole pad of claim 4, wherein said cup is metal, said metallic base having a plurality of holes at regular intervals between said stem portion and a periphery of said metallic base.

6. The tone hole pad of claim 4, wherein said circular metallic base has a beveled portion formed on a peripheral portion of a rear surface thereof so as to conform with a curved portion of said cup.

7. The tone hole pad of claim 4, wherein said stem portion has an internal female screw and said washer has a screw holding said washer and threaded into said female screw.

8. The tone hole pad of claim 4, wherein said holder has a lip extending toward the center of said holder to hold said pad assembly therein.

9. The tone hole pad of claim 4, wherein said pad assembly comprises a felt body having an upper surface coated with resin film and an elastic resin plate.

10. The tone hole pad of claim 4, and further comprising mount paper interposed between said holder and said circular base.

* * * * *